US011828008B2

(12) United States Patent
Jiang et al.

(10) Patent No.: US 11,828,008 B2
(45) Date of Patent: Nov. 28, 2023

(54) FLAT-KNITTED THREE-DIMENSIONAL FABRIC WITH INTERNAL SUPPORT STRUCTURE, AND METHOD FOR PREPARING SAME

(71) Applicant: JIANGNAN UNIVERSITY, Jiangsu (CN)

(72) Inventors: Gaoming Jiang, Jiangsu (CN); Zhe Gao, Jiangsu (CN); Honglian Cong, Jiangsu (CN); Guangjun Wu, Jiangsu (CN); Jiangtao Tan, Jiangsu (CN); Mengmeng Zhou, Jiangsu (CN)

(73) Assignee: JIANGNAN UNIVERSITY, Jiangsu (CN)

( * ) Notice: Subject to any disclaimer, the term of this patent is extended or adjusted under 35 U.S.C. 154(b) by 176 days.

(21) Appl. No.: 17/603,946

(22) PCT Filed: Apr. 22, 2021

(86) PCT No.: PCT/CN2021/088916
§ 371 (c)(1),
(2) Date: Oct. 15, 2021

(87) PCT Pub. No.: WO2021/253974
PCT Pub. Date: Dec. 23, 2021

(65) Prior Publication Data

US 2023/0037440 A1 Feb. 9, 2023

(30) Foreign Application Priority Data

Jun. 15, 2020 (CN) ..... 202010542273.4

(51) Int. Cl.
*D04B 1/10* (2006.01)
*D04B 1/12* (2006.01)

(52) U.S. Cl.
CPC ..... *D04B 1/104* (2013.01); *D04B 1/12* (2013.01); *D10B 2331/04* (2013.01); *D10B 2401/10* (2013.01)

(58) Field of Classification Search
CPC . D04B 1/104; D04B 1/12; D04B 7/12; D04B 9/12; D04B 21/10; D04B 23/08
See application file for complete search history.

(56) References Cited

U.S. PATENT DOCUMENTS 5,385,036 A * 1/1995 Spillane ..... D04B 21/18 66/196
6,105,401 A * 8/2000 Chadeyron ..... D04B 1/22 66/196

(Continued)

*Primary Examiner* — Danny Worrell
(74) *Attorney, Agent, or Firm* — HAUPTMAN HAM, LLP

(57) ABSTRACT

A flat-knitted three-dimensional fabric with an internal support structure, and the fabric is consisted of an upper surface layer, a lower surface layer, and a support structure yarn in a middle, wherein the upper surface layer and the lower surface layer comprise alternate-knitted single-sided stitches and fully-knitted single-sided stitches; the upper surface layer and the lower surface layer are connected by means of tuck knitting of the support structure yarn in the middle to form the integrally formed three-dimensional fabric with an internal support structure; and the alternate-knitted single-sided stitches are correspond to tuck loops formed by the support structure yarn and are used to lock the tuck loops formed by the support structure yarn in the middle, such that the support structure yarn will not puncture the surfaces of the fabric when the fabric is pressed.

15 Claims, 1 Drawing Sheet

(56) References Cited

U.S. PATENT DOCUMENTS

| | | | | |
|---|---|---|---|---|
| 7,565,821 | B2 * | 7/2009 | Park | F25B 21/04 66/195 |
| 7,658,087 | B1 * | 2/2010 | McMurray | D04B 1/18 66/196 |
| 7,849,715 | B2 * | 12/2010 | Starbuck | A41C 5/00 66/196 |
| 8,765,253 | B1 * | 7/2014 | Smaldone | D04B 21/16 428/218 |
| 9,551,095 | B2 * | 1/2017 | Lee | D04B 15/367 |
| 9,743,705 | B2 * | 8/2017 | Thomas | A43B 23/0215 |
| 11,105,025 | B2 * | 8/2021 | Boylu | D04B 21/207 |
| 2004/0099016 | A1 * | 5/2004 | Shepherd | D04B 1/18 66/8 |
| 2023/0037440 | A1 * | 2/2023 | Jiang | D04B 1/104 |

* cited by examiner

FLAT-KNITTED THREE-DIMENSIONAL FABRIC WITH INTERNAL SUPPORT STRUCTURE, AND METHOD FOR PREPARING SAME

RELATED APPLICATION

This is a U.S. national stage of international application No. PCT/CN2021/088916 filed on Apr. 22, 2021, which claims priority from China Patent Application No 202010542273.4 filed on Jun. 15, 2020, the entire content of which is incorporated by reference.

BACKGROUND OF THE INVENTION

1. Technical Field

The invention relates to a flat-knitted three-dimensional fabric with an internal support structure, and a method for preparing the same, and belongs to the technical field of flat knitting.

2. Description of Related Art

Flat-knitted three-dimensional fabrics with an internal support structure, also referred to as three-dimensional fabrics, are formed by connecting two independent fabric layers by means of a yarn or a fabric layer, and have good special properties in breathability, structural integrity, compression elasticity, moisture permeability and absorbability, and elastic controllability. Three-dimensional fabrics with an internal support structure and a meshed structure not only have better breathability and lower weight, but also are more attractive because of their meshes of different sizes and structures; in addition, the three-dimensional fabrics with an internal support structure and added with meshes without decreasing their surface density may be applied to composites to increase of the fiber volume content of the composites, thus further improving various mechanical properties of the composites.

Existing flat-knitted three-dimensional fabrics with an internal support structure and surfaces with meshes and preparation methods thereof mainly have the following two defects: first, an internal support structure yarn may protrude out of the surfaces of the fabrics when the fabrics are pressed from the outside, thus compromising the comfort of the fabrics during use; second, meshes on the surfaces of the flat-knitted three-dimensional fabrics with an internal support structure are prepared by a double-needle bed flat knitting machine, so the meshes can be formed merely in the case where a front needle bed and a back needle bed have idle needles for loop transfer, resulting in a low surface density of upper and lower surface layers of the fabrics.

As can be seen from the above description, the flat-knitted three-dimensional fabrics with an internal support structure and surfaces with meshes in the prior art still have defects in usability and aesthetics.

SUMMARY OF THE INVENTION

To solve the above problems, the present invention added single-sided stitches after the support structure yarn by tuck stitch are knitted to lock the tuck structure, such that the support structure yarn will not puncture the surfaces of a fabric when pressed; and a four-needle bed computerized flat knitting machine is used for knitting a three-dimensional fabric with an internal support structure, such that mesh structures are formed on an upper surface layer and a lower surface layer of the fabric under the condition that the upper surface layer and the lower surface layer of the three-dimensional fabric with an internal support structure are fully knitted.

A first objective of the invention is to provide a flat-knitted three-dimensional fabric with an internal support structure. The fabric is consisted of an upper surface layer, a lower surface layer, and a support structure yarn in the middle, wherein the upper surface layer and the lower surface layer comprise alternate-knitted single-sided stitches and fully-knitted single-sided stitches; the upper surface layer and the lower surface layer are connected by means of tuck knitting of the support structure yarn in the middle to form the integrally formed three-dimensional fabric with an internal support structure; the alternate-knitted single-sided stitches correspond to tuck loops formed by the support structure yarn and are used to lock the tuck loops formed by the support structure yarn in the middle, such that the support structure yarn will not puncture the surfaces of the fabric when the fabric is pressed.

In one implementation of the invention, the upper surface layer and the lower surface layer of the fabric further comprise meshes, and the meshes on the upper surface layer and the meshes on the lower surface layer are formed by a loop-transfer knitting process.

In one implementation of the invention, a yarn of the upper surface layer and the lower surface layer of the fabric is a yarn for common clothes, or a high-performance yarn.

In one implementation of the invention, the support structure yarn in the middle of the fabric is a 50 D-1000 D polyester monofilament.

In one implementation of the invention, the thickness of the fabric is controlled to 5 mm-28 mm by changing the diameter of the yarn and the distance between the tuck loops of the support structure yarn.

A second objective of the invention is to provide a method for preparing a flat-knitted three-dimensional fabric with an internal support structure. According to the method, the fabric is knitted on a four-needle bed computerized flat knitting machine, and an upper surface layer and a lower surface layer of the fabric are two single-sided stitch fabrics knitted by the computerized flat knitting machine; and meshes on the upper surface layer and meshes on the lower surface layer are formed by a loop-transfer knitting process of the computerized flat knitting machine.

In one implementation of the invention, the method comprises: knitting two courses of fully-knitted single-sided stitches of the upper surface layer and the lower surface layer from a yarn on the four-needle bed computerized flat knitting machine provided with an electronic needle selection device by means of a tubular knitting process, then knitting tuck loops on two needle beds, used for knitting the upper surface layer and the lower surface layer, from a support structure yarn to connect the upper surface layer and the lower surface layer into a whole, then knitting two wales of fully-knitted single-sided stitches of the upper surface layer and the lower surface layer on the computerized flat knitting machine by means of the tubular knitting process, and then knitting two courses of single-sided stitches every one stitch from the yarn of the upper surface layer and the lower surface layer on the computerized flat knitting machine by means of the tubular knitting process, wherein after the support structure yarn is tuck-knitted, the one-sided stitches are knotted every one stitch to lock tuck loop structures, such that the support structure yarn is prevented from punching surfaces of the fabric when the fabric is pressed.

In one implementation of the invention, the meshes are formed by loop transfer by 1-8 stitches of a loop-transfer process of the computerized flat knitting machine when the fully-knitted single-sided stitches of the upper surface layer and the lower surface layer are knotted, such that size-variable mesh structures are formed under the condition that a large surface density of the fabric is guaranteed.

In one implementation of the invention, the single-sided stitches of the upper surface layer and the lower surface layer of the fabric are weft plain stitches knitted from the yarn, and the yarn of the upper surface layer and the lower surface layer is a same yarn and is fed by a common yarn guide.

In one implementation of the invention, tuck looping of the support structure yarn in the middle on the computerized flat knitting machine is as follows: multiple layers of tuck loops with the same connecting distance are alternate-knitted on the computerized flat knitting machine.

In one implementation of the invention, the fabric is knitted on a four-needle bed computerized flat knitting machine which is provided with a front lower needle bed, a back lower needle bed, a front upper needle bed and a back upper needle bed, wherein the front lower needle bed and the back lower needle bed are able to perform both knitting and loop transfer, the front upper needle bed and the back upper needle bed are able to perform both knitting and loop transfer or are able to perform loop-transfer only, and the gauge of the four-needle bed computerized flat knitting machine is selected from E8-E18.

In one implementation of the invention, loop transfer by 1-8 stitches is performed by the four-needle bed computerized flat knitting machine when the fully-knitted single-sided stitches of the upper surface layer and the lower surface layer are knitted, so as to form meshes on the upper surface layer and meshes on the lower surface layer. Loop transfer for forming the meshes cannot be realized when a common double-needle bed flat knitting machine is used to knit a fabric with upper and lower surface layers with full needle because loop transfer needs to be performed by idle needles, while no idle needle is available during full knitting. By adoption of the four-needle bed flat knitting machine, loop transfer for forming the meshes is performed by means of idle needles on the front upper needles and the back upper needles when the front lower needle bed and the back lower needle bed are used to knit the fabric with the upper and lower fabric layers, such that the meshes are formed when the fabric with the upper and lower surface layers are fully knitted.

In one implementation of the invention, the front upper needle bed and the back upper needle bed of the four-needle bed computerized flat knitting machine are used to assist in loop transfer on the back lower needle bed and the front lower needle bed, such that idle needles for reversing do not need to be reserved on the front lower needle bed and the back lower needle bed, and the upper surface layer and the lower surface layer of the three-dimensional fabric with the internal support structure are fully knitted, thus increasing the surface density of surfaces of the fabric.

In one implementation of the invention, the front upper needle bed and the back upper needle bed of the four-needle bed computerized flat knitting machine are able to perform both knitting and loop transfer or are able to perform loop transfer only.

A third objective of the invention is to provide an application of the flat-knitted three-dimensional fabric with an internal support structure to seat covers, shoe materials, bags, and mattresses.

The invention has the following beneficial effects:

According to the invention, the present invention added single-sided stitches after the support structure yarn by tuck stitch are knitted to lock the tuck structure, such that the support structure yarn will not puncture the surfaces of the fabric when the fabric is pressed. The four-needle bed computerized flat knitting machine is used for knitting the fabric, such that mesh structures are formed on the upper surface layer and the lower surface layer of the fabric under the condition that the upper surface layer and the lower surface layer of the three-dimensional fabric structure with an internal support structure are fully knitted, thus improving the breathability of the fabric.

DETAILED DESCRIPTION OF PREFERRED EMBODIMENTS OF THE INVENTION

The preferred embodiments of the invention will be described below. It should be understood that the following embodiments are merely used to better explain the invention, and are not intended to limit the invention.

Figure 1:
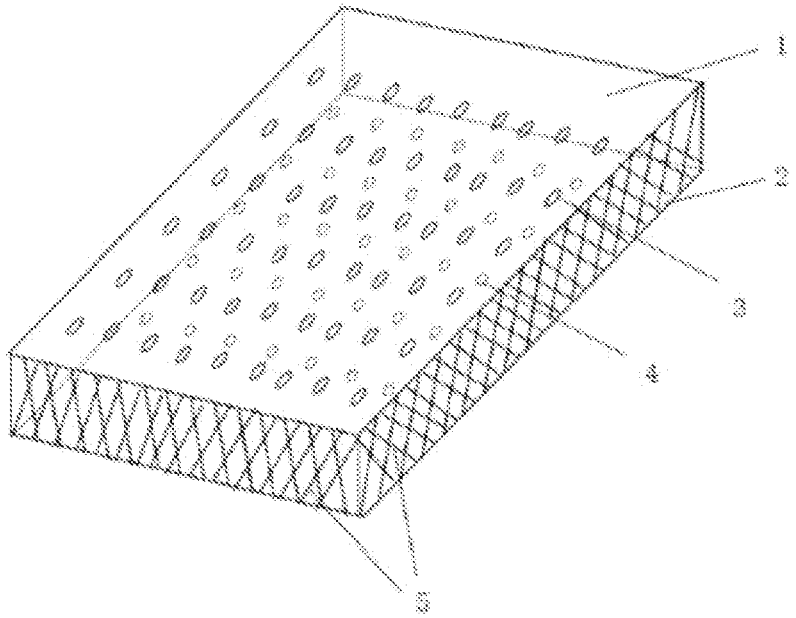
FIG. 1 is a structural diagram of a flat-knitted three-dimensional fabric with an internal support structure and surfaces with meshes according to the invention, wherein 1, upper surface layer; 2, lower surface layer; 3, mesh on the upper surface layer; 4, mesh on the lower surface layer; 5, support structure yarn.

Embodiment 1: Flat-Knitted Three-Dimensional Fabric with an Internal Support Structure As shown in FIG. 1, a flat-knitted three-dimensional fabric with an internal support structure comprises a fabric body, wherein the fabric body is consisted of an upper surface layer 1, a lower surface layer 2, and a support structure yarn 5 in the middle. The upper surface layer 1 and the lower surface layer 2 are two single-sided stitch fabrics knitted by a computerized flat knitting machine. Wherein, single-sided stitches of the upper surface layer 1 and the lower surface layer 2 comprise alternate-knitted single-sided stitches, fully-knitted single-sided stitches and meshes. The meshes 3 on the upper surface layer and the meshes 4 on the lower surface layer are formed by a loop-transfer knitting process of the computerized flat knitting machine. The upper surface layer 1 and the lower surface layer 2 are connected by means of the support structure yarn 5 in the middle by tuck stitch to form the integrally formed three-dimensional fabric with an internal support structure. Wherein, the upper surface layer 1 and the lower surface layer 2 of the fabric may be knitted from the same yarn fed by the same yarn guide, such that side edges of the fabric of the invention are automatically sewn together.

The single-sided stitches of the upper surface layer 1 and the lower surface layer 2 of the fabric comprises the alternate-knitted single-sided stitches used for locking tuck loops formed by the support structure yarn in the middle, such that the support structure yarn will not puncture the surfaces of the fabric when the fabric is pressed.

The single-sided stitches of the upper surface layer 1 and the lower surface layer 2 comprise the fully-knitted single-sided stitches that are knitted on the upper surface layer 1 and the lower surface layer by means of loop transfer by 1-8 stitches of the loop transfer process of the computerized flat knitting machine, such that size-variable mesh structures are formed under the condition that a large surface density of the fabric is guaranteed.

The single-sided stitches of the upper surface layer 1 and the lower surface layer 2 of the fabric are weft plain stitches knitted from a yarn, and the upper surface layer 1 and the lower surface layer 2 may be knitted from the same yarn fed by a common yarn guide.

The support structure yarn 5 in the middle is tuck-knitted on the computerized flat knitting machine to form multiple layers of tuck loops with the same connecting distance. Wherein, the connecting distance may be adjusted according to the thickness of the desired three-dimensional fabric with an internal support structure; the thickness of the fabric may be controlled to 5 mm-28 mm by changing the diameter of the yarn and the distance between the tuck loops of the support structure yarn; the surface density of the fabric is 0.04 g/cm$^2$-0.36 g/cm$^2$; and the breathability of the fabric is 160-880 mm/s.

Embodiment 2: Method for Preparing a Flat-Knitted Three-Dimensional Fabric with an Internal Support Structure This embodiment provides a method for preparing a flat-knitted three-dimensional fabric with an internal support structure, wherein the fabric comprises a fabric body consisted of an upper surface layer 1, a lower surface layer 2, and a support structure yarn 5 in the middle. The upper surface layer 1 and the lower surface layer 2 are two single-sided stitch fabrics knitted by a computerized flat knitting machine. Wherein, single-sided stitches of the upper surface layer 1 and the lower surface layer 2 comprise alternate-knitted single-sided stitches, fully-knitted single-sided stitches and meshes. The meshes 3 on the upper surface layer and the meshes 4 on the lower surface layer are formed by a loop-transfer knitting process of the computerized flat knitting machine. The upper surface layer 1 and the lower surface layer 2 are connected by tuck stitch by means of the support structure yarn 5 in the middle to form the integrally formed three-dimensional fabric with the internal support structure. The method comprises the following steps:

Two courses of fully-knitted single-sided stitches of the upper surface layer 1 and the lower surface layer 2 are knitted from the same yarn on a four-needle bed computerized flat knitting machine provided with an electronic needle selection device by means of a tubular knitting process; then, tuck loops are knitted from the support structure yarn 5 on two needle beds for knitting the upper surface layer 1 and the lower surface layer 2 to connect the upper surface layer 1 and the lower surface layer 2 into a whole; next, two wales of fully-knitted single-sided stitches of the upper surface layer 1 and the lower surface layer 2 are knitted on the computerized flat knitting machine by means of the tubular knitting process; then, two courses of single-sided stitches are knitted every one stitch from the yarn of the upper surface layer 1 and the lower surface layer 2 on the computerized flat knitting machine by means of the tubular knitting process, wherein after the tuck loops are knitted from the support structure yarn 5, the single-sided stitches are knitted every one stitch to lock the tuck loops, such that the support structure yarn will not puncture the surfaces of the fabric when the fabric is pressed.

According to the method, when the fully-knitted single-sided stitches of the upper surface layer 1 and the lower surface layer 2 are knitted, loop transfer by 1-8 stitches may be performed by the four-needle bed computerized flat knitting machine to form the meshes 3 on the upper surface layer and the meshes 4 on the lower surface layer, wherein a front upper needle bed and a back upper needle bed of the four-needle bed computerized flat knitting machine are used to assist in loop transfer on a back lower needle bed and a front lower needle bed, so idle needles for reversing do not need to be reserved on the front lower needle bed and the back lower needle bed, and the upper surface layer 1 and the lower surface layer 2 of the three-dimensional fabric with an internal structure are fully knitted, thus improving the surface density of the surfaces of the fabric.

The front upper needle bed and the back upper needle bed of the four-needle bed computerized flat knitting machine are able to perform both knitting and loop transfer or are able to perform loop transfer only.

Figure 2:
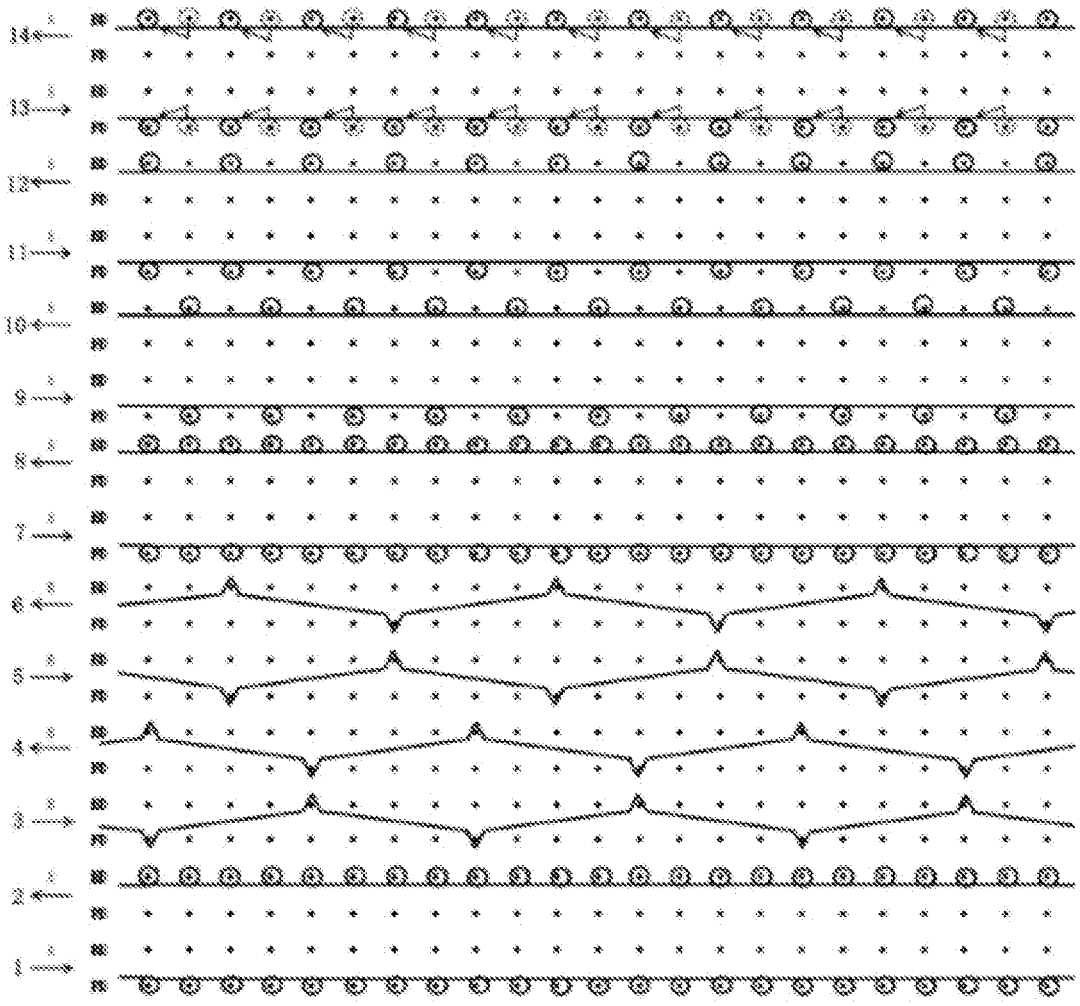
FIG. 2 is a knitting principle diagram of the flat-knitted three-dimensional with an internal support structure and surfaces with meshes according to the invention.

To knit the flat-knitted three-dimensional fabric with an internal support structure and surfaces with meshes in Embodiment 1, this embodiment specifically adopts the following knitting method:

As shown in FIG. 2, knitting is performed on a four-needle bed computerized flat knitting machine, and two yarn guides A and B are used, wherein A represents a yarn guide for 900 D polyamide yarns, B represents a yarn guide for 400 D polyester monofilaments; FD represents a front lower needle bed, and BD represents a back lower needle bed.

→ and ← represent movement directions of the yarn guides and respectively indicate that the yarn guides move front left to right and from right to left.

• represents needles on the needle bed.

represents loops knitted on the front lower needle bed.

represents loops knitted on the back lower needle bed.

represents tuck loops knitted on the front lower needle bed.

represents tuck loops knitted on the back lower needle bed.

represents leftward transfer by one stitch of loops on the front lower needle bed.

represents leftward transfer by one stitch of loops on the back lower needle bed.

The knitting process is as follows:

A first course and a second course are knitted on the front lower needle bed FD and the back lower needle bed BD respectively by means of the yarn guide A, that is, the upper surface layer and the lower surface layer of the fabric are formed respectively.

A third course to a sixth course are tuck-knitted every four stitches from the support structure yarn by means of the yarn guide B to connect the upper surface layer in the first course and the lower surface layer in the second course, wherein tuck loops knitted on the same needle bed are arranged at intervals.

A seventh course and an eighth course are knitted on the front lower needle bed FD and the back lower needle bed BD respectively by means of the yarn guide A.

Weft plain stitches of a ninth course are knitted every one stitch on the front lower needle bed FD by means of the yarn guide A.

Weft plain stitches of a tenth course are knitted every one stitch on the back lower needle bed BD by means of the yarn guide A.

Weft plain stitches of an eleventh course are knitted every one stitch in the ninth course by means of needles, not participating in alternate knitting, of the front lower needle bed FD by means of the yarn guide A.

Weft plain stitches of a twelfth course are knitted every one stitch in the tenth course by means of needles, not participating in alternate knitting, of the back lower needle bed BD by means of the yarn guide A.

Fully-knitted weft plain stitches of a thirteenth course are knitted on the front lower needle bed FD by means of the yarn guide A, and then needles on the back upper needle bed and the back upper needle bed are moved horizontally to transfer selected loops on the front lower needle bed leftwards by one stitch (one to eight stitches) by means of selected needles to form meshes on the upper surface layer.

Fully-knitted weft plain stitches of a fourteenth course are knitted on the back lower needle bed BD by means of the yarn guide A, then needles on the front upper needle bed and the back lower needle bed are moved horizontally to transfer selected loops on the back lower needle bed leftwards by one stitch (one to eight stitches) by means of selected needles to form meshes on the lower surface layer.

The whole fabric is cyclically knitted through the knitting method for 1-14 courses.

In this embodiment, the present invention added single-sided stitches after the support structure yarn by tuck stitch are knitted to lock the tuck structure, such that the support structure yarn will not puncture the surfaces of the fabric when the fabric is pressed. The four-needle bed computerized flat knitting machine is used for knitting the fabric, such that mesh structures are formed on the upper surface layer and the lower surface layer of the fabric under the condition that the upper surface layer and the lower surface layer of the three-dimensional fabric structure with an internal support structure are fully knitted, thus improving the breathability of the fabric.

In this embodiment, the fabric stands for 72 hours under a standard condition, namely under a temperature of 20° C. and a relative humidity of 65%, after being taken down from the knitting machine, and relevant parameters of the fabric are measured after deformation stress of yarns in the fabric is eliminated, wherein the thickness of the fabric is 8.24 mm, the surface density of the fabric is 0.12 g/cm$^2$, and the breathability of the fabric tested on a YG461E-III fully-automatic breathability instrument with reference to GB/T5453:1997 (test of breathability of textile fabric) is 840 mm/s.

Although the preferred embodiments have been disclosed above, these preferred embodiments are not intended to limit the invention. Any skilled in the art may make different modifications and embellishments without departing from the spirit and scope of the invention. Thus, the protection scope of the invention should be the protection scope defined by the claims.

What is claimed is:

1. A flat-knitted three-dimensional fabric with an internal support structure, being consisted of an upper surface layer, a lower surface layer, and a support structure yarn in a middle, wherein the upper surface layer and the lower surface layer comprise alternate-knitted single-sided stitches and fully-knitted single-sided stitches; the upper surface layer and the lower surface layer are connected by means of tuck knitting of the support structure yarn in the middle to form the integrally formed three-dimensional fabric with an internal support structure; and the alternate-knitted single-sided stitches are connected to tuck loops formed by the support structure yarn and are used to lock the tuck loops formed by the support structure yarn in the middle, wherein the fabric is knitted on a four-needle bed computerized flat knitting machine, and the upper surface layer and the lower surface layer of the fabric are two single-sided stitch fabrics knitted by the computerized flat knitting machine, and wherein the support structure yarn in the middle is tuck-knitted on the computerized flat knitting machine as follows: multiple layers of tuck loops with a same connecting distance are alternate-knitted between a front lower needle bed and a back lower needle bed.

2. The flat-knitted three-dimensional fabric with an internal support structure according to claim 1, wherein the upper surface layer and the lower surface layer of the fabric further comprise meshes, and the meshes on the upper surface layer and the meshes on the lower surface layer are formed by a loop-transfer knitting process.

3. The flat-knitted three-dimensional fabric with an internal support structure according to claim 1, wherein the support structure yarn in the middle of the fabric is a 50 D-1000 D polyester monofilament.

4. The flat-knitted three-dimensional fabric with an internal support structure according to claim 1, wherein a thickness of the flat-knitted three-dimensional fabric with an internal support structure is 5 mm-28 mm.

5. The method according to claim 1, comprising: knitting two courses of fully-knitted single-sided stitches of the upper surface layer and the lower surface layer from a yarn on the four-needle bed computerized flat knitting machine provided with an electronic needle selection device by means of a tubular knitting process, then knitting tuck loops on two needle beds, used for knitting the upper surface layer and the lower surface layer, from a support structure yarn to connect the upper surface layer and the lower surface layer into a whole, then knitting two wales of fully-knitted single-sided stitches of the upper surface layer and the lower surface layer on the computerized flat knitting machine by means of the tubular knitting process, and then knitting two courses of single-sided stitches every one stitch from the yarn of the upper surface layer and the lower surface layer on the computerized flat knitting machine by means of the tubular knitting process, wherein after the support structure yarn is tuck-knotted, the one-sided stitches are knotted every one stitch to lock tuck loop structures, such that the support structure yarn is prevented from punching surfaces of the fabric when the fabric is pressed.

6. The method according to claim 1, wherein the computerized flat knitting machine is a four-needle bed computerized flat knitting machine and is provided with a front lower needle bed, a back lower needle bed, a front upper needle bed and a back upper needle bed, wherein the front lower needle bed and the back lower needle bed are able to perform both knitting and loop transfer, and the front upper needle bed and the back upper needle bed are able to perform both knitting and loop transfer or are able to perform loop-transfer only.

7. The method according to claim 1, wherein the upper surface layer and the lower surface layer of the fabric further comprises meshes, and the meshes are formed by loop transfer by 1-8 stitches of a loop-transfer process of the computerized flat knitting machine when the fully-knitted single-sided stitches of the upper surface layer and the lower surface layer are knitted, such that size-variable mesh structures are formed under the condition that a large surface density of the fabric is guaranteed.

8. A seat cover comprising the flat-knitted three-dimensional fabric with an internal support structure according to claim 1.

9. A shoe comprising the flat-knitted three-dimensional fabric with an internal support structure according to claim 1.

10. A bag comprising the flat-knitted three-dimensional fabric with an internal support structure according to claim 1.

11. A mattress comprising the flat-knitted three-dimensional fabric with an internal support structure according to claim 1.

12. The flat-knitted three-dimensional fabric with an internal support structure according to claim 2, wherein the support structure yarn in the middle of the fabric is a 50 D-1000 D polyester monofilament.

13. The method according to claim 5, wherein the support structure yarn in the middle is tuck-knitted on the computerized flat knitting machine as follows: multiple layers of tuck loops with a same connecting distance are alternate-knitted between a front lower needle bed and a back lower needle bed.

14. The method according to claim 6, wherein the upper surface layer and the lower surface layer of the fabric further comprises meshes, and the meshes are formed by loop transfer by 1-8 stitches of a loop-transfer process of the computerized flat knitting machine when the fully-knitted single-sided stitches of the upper surface layer and the lower surface layer are knitted, such that size-variable mesh structures are formed under the condition that a large surface density of the fabric is guaranteed.

15. The method according to claim 1, wherein the single-sided stitches of the upper surface layer and the lower surface layer of the fabric are weft plain stitches knitted from the yarn, and the yarn of the upper surface layer and the lower surface layer is a same yarn and is fed by a common yarn guide.

* * * * *